US006364101B1

(12) United States Patent
Schultz

(10) Patent No.: US 6,364,101 B1
(45) Date of Patent: Apr. 2, 2002

(54) EASILY OPENED WIPES CANISTER

(75) Inventor: Marissa A. Schultz, Caledonia, WI (US)

(73) Assignee: S. C. Johnson & Son, Inc., Racine, WA (US)

( * ) Notice: Subject to any disclaimer, the term of this patent is extended or adjusted under 35 U.S.C. 154(b) by 0 days.

(21) Appl. No.: 09/692,019

(22) Filed: Oct. 19, 2000

(51) Int. Cl.[7] ..... B65D 81/24

(52) U.S. Cl. ..... 206/210; 206/494; 220/375; 215/224; 215/306

(58) Field of Search ..... 206/210, 397, 206/581, 494, 205, 409; 220/780, 375; 215/224, 235, 306, 317, 321, 305

(56) References Cited

U.S. PATENT DOCUMENTS

| | | | | | |
|---|---|---|---|---|---|
| 2,953,271 | A | * | 9/1960 | Hohl et al. | 215/224 |
| 3,170,585 | A | * | 2/1965 | O'Donnell | 215/224 |
| 3,398,847 | A | * | 8/1968 | Towns | 215/224 |
| 3,871,662 | A | * | 3/1975 | Hepp et al. | 215/223 |
| 3,901,401 | A | * | 8/1975 | Lynn et al. | 215/223 |
| 3,907,145 | A | * | 9/1975 | Horvath | 215/224 |
| 3,934,745 | A | * | 1/1976 | Levell | 215/224 |
| 3,980,194 | A | * | 9/1976 | Costa | 215/224 |
| 4,187,953 | A | * | 2/1980 | Turner | 215/301 |
| 4,278,178 | A | * | 7/1981 | Geiser | 215/215 |
| 4,328,907 | A | | 5/1982 | Beard | |
| 4,337,876 | A | | 7/1982 | Thompson | |
| 4,462,507 | A | | 7/1984 | Margulies | |
| 4,580,687 | A | | 4/1986 | Lewis | |
| 5,076,424 | A | | 12/1991 | Nakamura | |

* cited by examiner

*Primary Examiner*—Shzan Luong

(57) ABSTRACT

A dispenser of moist wipes, towelettes, or liquid impregnated fibrous tissues, comprising a container, a lid having an orifice therein for withdrawal of the wipes, and a cap over the orifice to prevent evaporation of liquid from the container. The wipes may be placed in the container in roll form, and withdrawn sequentially and individually by pulling through the orifice and tearing apart at perforations between the wipes. The lid is removably attached by a snap fit to the container, and the lower edge of the lid is protected by an outwardly extending circumferential protrusion on the vertical side of the container adjacent the lower edge of the lid, so as to inhibit accidental removal of the lid. An opening is provided in the protrusion to permit removal of the lid as desired.

10 Claims, 5 Drawing Sheets

EASILY OPENED WIPES CANISTER

RELATED APPLICATION(S)

Not applicable.

FEDERALLY SPONSORED RESEARCH OR DEVELOPMENT

Not applicable.

BACKGROUND OF THE INVENTION

1. Technical Field

The present invention relates to a container/dispenser for fibrous pads, wipes, or towels, generally linked together as a succession of individual wipes to be drawn from the dispenser as needed.

2. Background Information

It is well known to provide individual wipes or cleansing fabrics in the form of sachets contained in sealed foil or like impervious packages, containing one or two moistened and/or medication impregnated paper or fabric sheets. Typically, such sachets comprise a non-woven fabric impregnated with an alcohol based cleanser, perfume, and/or medicament. Such wipes are frequently used for face wipes, for cleaning hands when away from washing facilities, or for wiping the site of an injection just prior thereto. In addition, it has been proposed to use such sachets as baby wipes, for cleansing an infant at the time of a diaper change, for example. Such sachets have the disadvantage of requiring opening of a sealed package or packet just prior to use, a time consuming and delaying factor. However, it is also known to provide a linked succession of such wipes which may be drawn from a single container in sequence, as needed, through an opening at the top of the container. Such containers are typically cylindrical in shape, with a small opening in the top thereof through which the wipes may be drawn, the wipes being joined in the shape of a rope, or as a roll of wipes, within the container. Such a container shall be hereinafter referred to a dispenser, a canister, or a cylindrical container for such wipes. While such dispensers shall be generally referred to herein as being cylindrical, it is to be understood that other shapes are included, such as cubic. Thus, the present invention encompasses containers having horizontal cross-sections which may be circular, oval, square, rectangular, or of any shape forming a container in which wipes or impregnated tissues may be provided.

One of the typical methods of the prior art with respect to such dispensers has been to provide a linked succession of moist non-woven fabric wipes, with tear lines between the individual wipes, defined by perforations which permit one wipe to be torn from the next in succession with a minimal effort, but which are sufficiently resistant to tearing to permit one wipe to draw the next through an opening in the container. Typically the wipes are stored within the dispenser as a loose roll, and the dispenser comprises a closed cylindrical container of synthetic polymer material, having a removable lid at one end. For use, the lid of the container is removed, and the first wipe, (or the end of the roll of wipes, which is usually at the inside of the roll of wipes) is extracted and passed through an opening or through hole in the lid, and the lid is then replaced on the cylindrical body of the dispenser. Successive wipes may then be drawn through the hole in the lid by pulling on the preceding wipe. After tearing the leading wipe from the succeeding wipe, by separating at the perforation, the leading wipe may be opened and used. The end of the succeeding wipe which has been pulled through the hole in the lid, is conventionally covered by a snap-closure which fits tightly over the through hole, often locking the succeeding wipe in place, and prevents evaporation of liquid from the wipes retained within the container, thus keeping the succeeding wipes from drying out.

A dispenser as described above is set forth in U.S. Pat. No. 4,328,907, of Beard, which teaches a dispenser for moistened tissues, wherein successive wipes are drawn through an orifice in the lid. The orifice is provided with a sealing cap providing closure and sealing between acts of dispensing a wipe. The wipes are provided as a roll of wipes positioned within the cylindrical dispenser, and are drawn sequentially from the roll through the orifice in the lid for usage. The lid constitutes a cover for the cylindrical dispenser, said cover having a horizontal top surface, and a peripheral skirt extending downwardly from said top surface, said skirt terminating in a thickened rim to fit into a corresponding circumferential recess in the body of the cylindrical dispenser body to thereby be engaged to the dispenser body. The lid of Beard also demonstrates the use of an integral flexible ring lid, extending from the underside of, and coaxial with, the lid, which engages with the inner edge of an internally directed flexible integral peripheral flange at the top of the dispenser body.

As previously indicated, it is necessary for the consumer to "start" the dispenser roll. This is normally accomplished by removing the lid of the dispenser from the body of the dispenser, grasping the end of the first wipe to be dispensed from the roll, and passing the end of said wipe through the orifice in the lid, after which the lid is returned to the cylindrical dispenser, and with considerable force, snapped back in place thereupon. After the first wipe is drawn through the orifice, and torn off at the perforations in the roll, the cap may then be closed over the orifice, to keep the liquid in the remaining wipes from evaporating, and the succeeding wipe is held in place. However, a problem with this step of "starting" the dispenser roll is that the removal of the lid of the dispenser from the body of the dispenser is difficult, and frequently results in frustration for the consumer, and occasionally broken nails, scraped fingers, and aggravation. Since it is intended that the lid fit over the body of the dispenser tightly, so as to limit evaporation from the contents thereof, the fit of the lid over the body is necessarily tight, often resulting in damage to the sealing members during removal of the lid.

Moreover, such a closure or lid prevents ready access by the consumer to the contents of the dispenser, such as for example, for replacement of the roll of wipes contained therein, or removal of the roll of wipes so as to be able to tear off a number of wipes at one time.

One means to provide a readily removable lid for a dispensing body of the type described has been to provide a threaded closure for the lid on the cylindrical body. While this type of closure does provide more convenient removal, requiring less physical effort by the consumer, such threaded lids unfortunately present their own problems. Such threaded closures are more expensive to manufacture, thus making the product less acceptable to the consumer.

Thus, a need exists for improved dispensers having lid closures, whereby the consumer may readily remove the lid as desired, with a lesser degree of effort, and may reseal the lid over the dispenser without concern for leakage or damage to the sealing means.

SUMMARY OF THE INVENTION

In one aspect, the invention comprises an improved configuration of a dispenser for moistened wipes, said dispenser having a removable lid with an orifice therein for passage of wipes to the exterior for usage.

In a preferred embodiment, the improved dispenser comprises a cylindrical body having means on the exterior surface for retention of a lid, said means comprising an external closure flange engaging an internal protrusion at the bottom of the downwardly extending skirt of the lid. The improvement of the present invention is the provision of means by which the consumer may more readily remove the lid, by pressing upwardly upon the lower edge of the skirt of said lid, in a depressed area of the cylindrical body which permits insertion of a finger, thumb, or implement to press the lid upwardly.

In a preferred embodiment of the invention, the lower edge of the skirt of said lid is protected from accidental engagement with objects which would tend to push the skirt upwardly and remove the lid from the engagement with the external closure flange of the cylindrical body of said dispenser. In this form, the invention provides an outwardly protruding surface on the exterior surface of the cylindrical body of the dispenser, coaxial with both the body of the dispenser and the lid, which protrusion extends outwardly from the cylindrical body at least far enough to be cylindrically planar with the downwardly extending skirt of said lid. This protrusion may be referred to hereinafter as the protruding skirt protection means. However, a portion of said protruding surface on the exterior surface of said cylindrical body is removed, so as to allow the consumer to insert a finger, thumb, nail, or implement under the lower edge of said skirt of said lid, so as to permit its easy removal when desired. By the term "removed", it is intended to include areas where the protrusion is not present due to the molding of the cylindrical body being so configured that no protrusion is present for a specific region.

The objects of the present invention therefore include providing a wipes dispenser in which the lid is easily removable for "starting" the passage of the wipes through the orifice in the lid. Accordingly, it is an object of the present invention to provide a means by which the lid of a dispensing body may be readily removed as necessary or desired, for purposes of attaining access to the contents of the body.

These and still other objects and advantages of the present invention will be apparent from the description which follows. The following description is merely of the preferred embodiments. Thus, the claims should be looked to in order to understand the full scope of the invention.

DETAILED DESCRIPTION OF THE INVENTION

Figure 1:
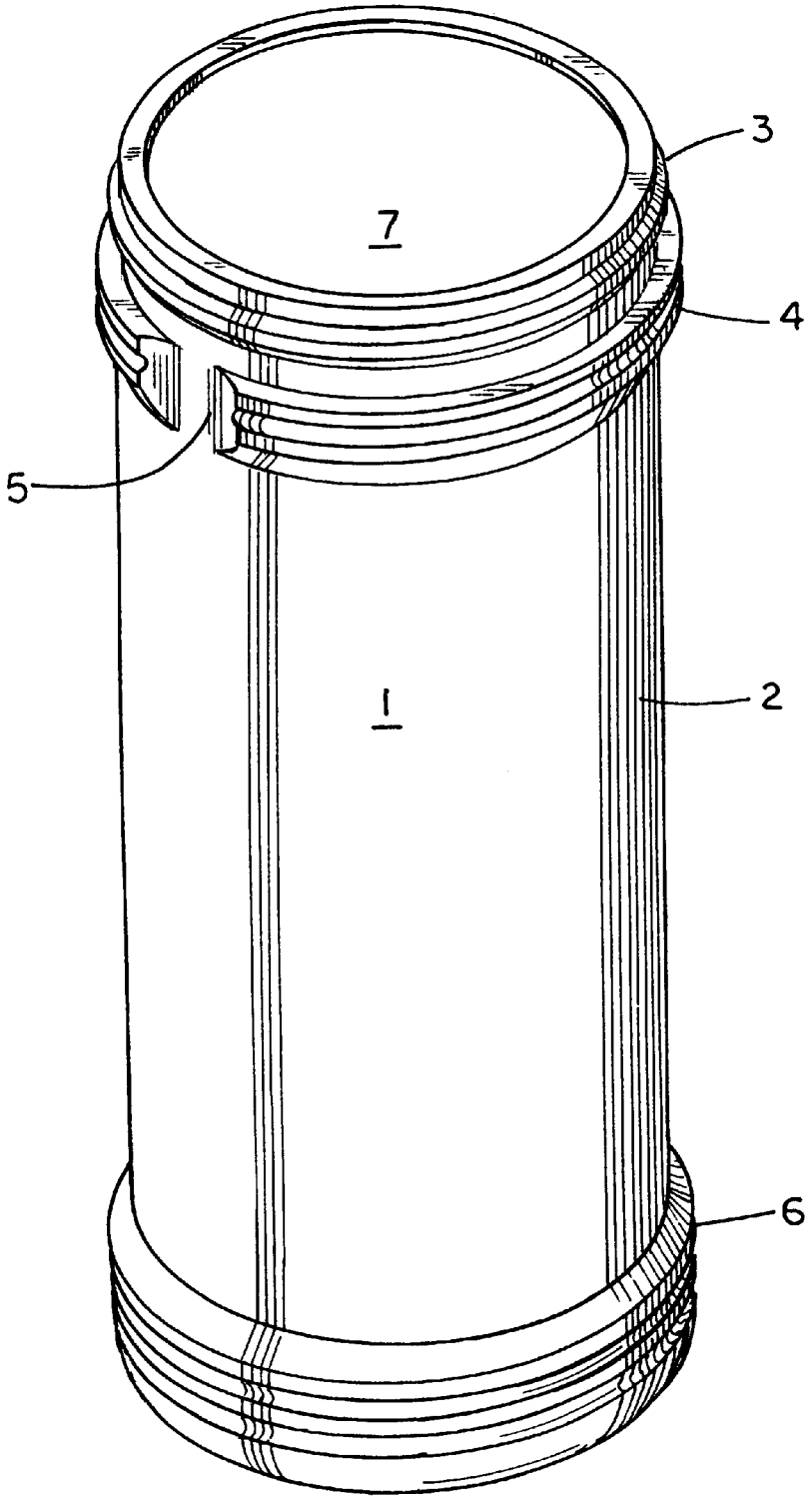
FIG. 1 is a perspective view of a cylindrical dispenser body in accordance with the present invention.
Figure 2:
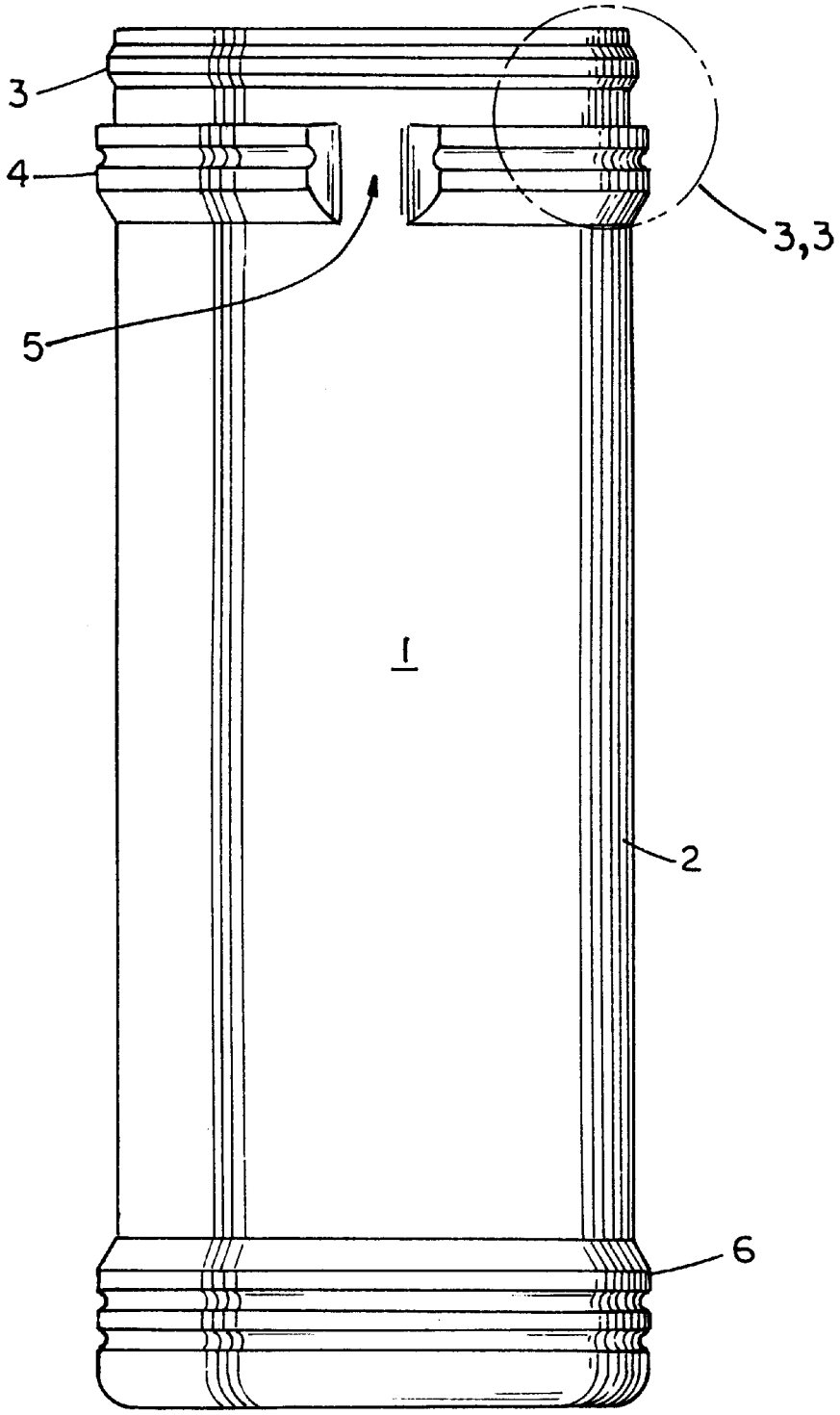
FIG. 2 is an elevational view of the dispenser body of FIG. 1, illustrating the external closure flange, the protruding skirt protection means, and the open area in said skirt protection means.
Figure 3:
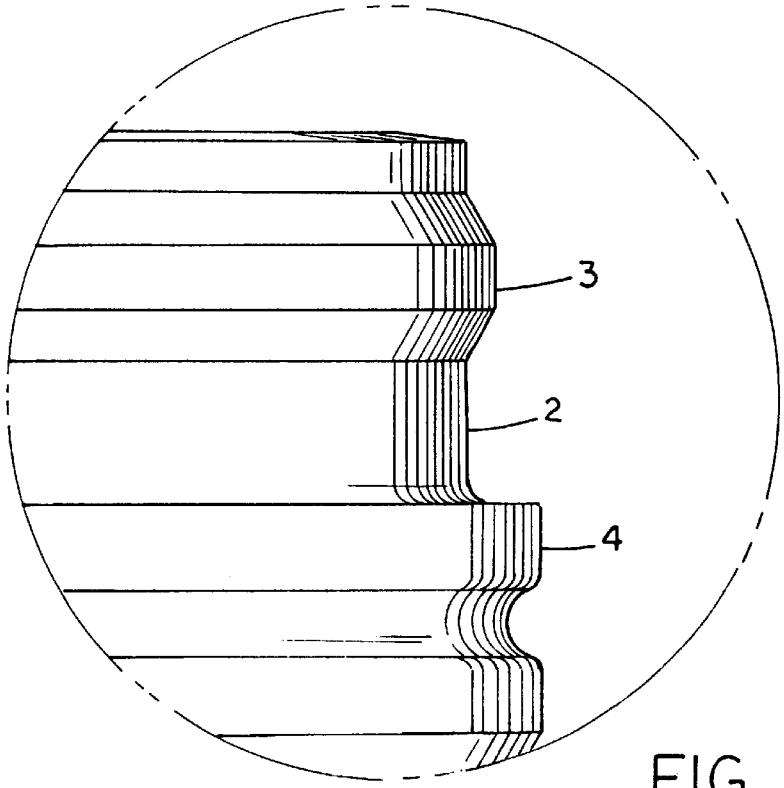
FIG. 3 is an enlarged view of the encircled area of FIG. 2, illustrating the relationship between the external closure flange and the skirt protection means.
Figure 4:
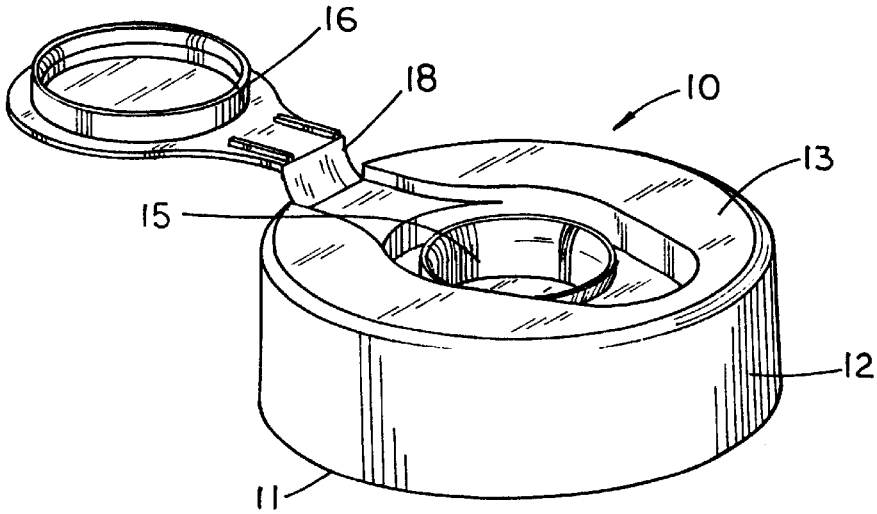
FIG. 4 is a perspective view of the lid of the present invention.
Figure 7:
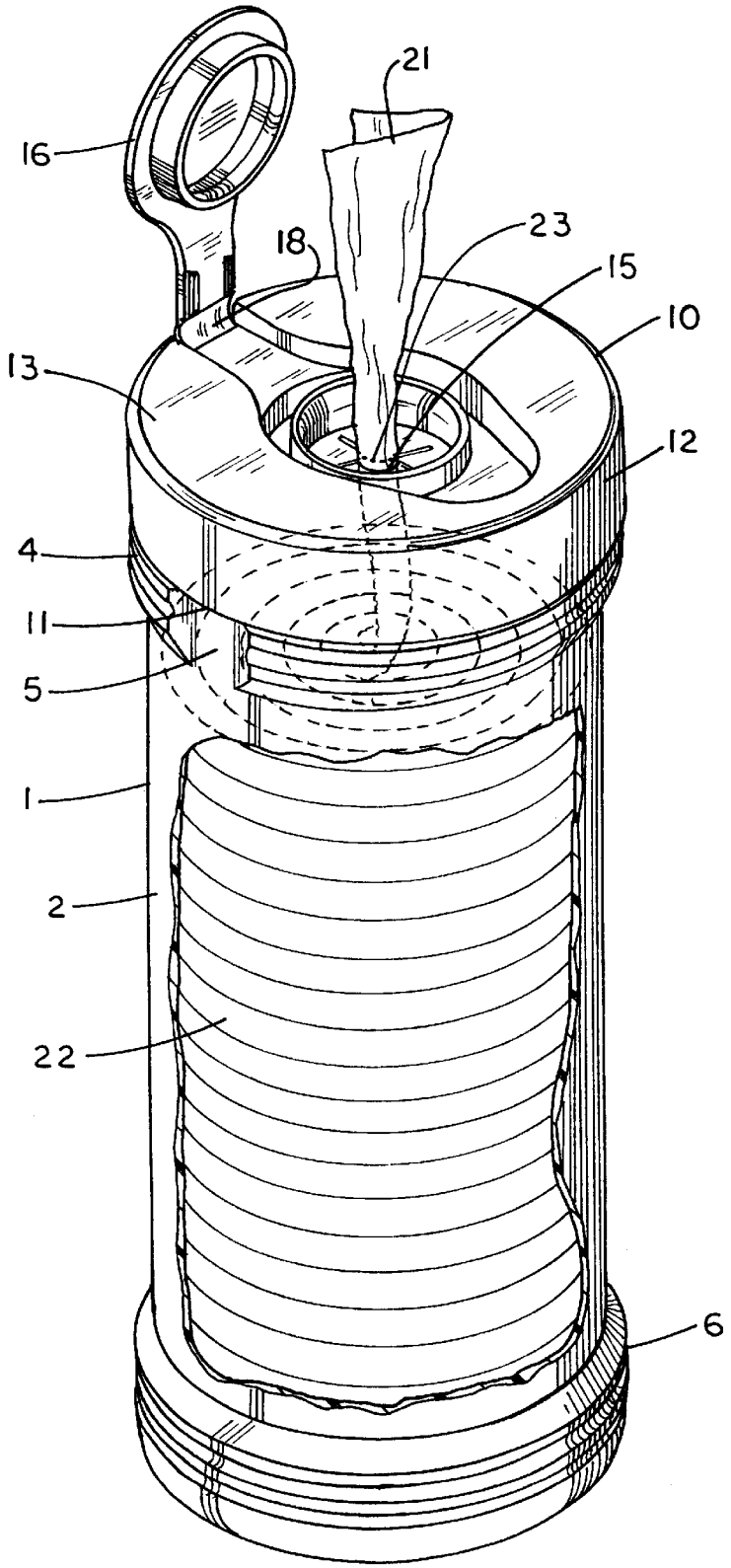
FIG. 7 is a perspective view, partially broken away, illustrating the dispenser body with lid and moist wipes in place.

FIGS. 1 and 4 illustrate the body and lid of the dispenser of the present invention separately, while FIG. 7 illustrates the body and lid joined to form a closed dispenser. The present invention may be readily understood through consideration of FIG. 7, in light of the remaining figures. In FIG. 7, a cylindrical dispenser body, 1, comprising a molded plastic container having vertical side walls 2, serves as a receptacle for a supply of joined wipes or towels, 22. The container, 1, is preferably made of synthetic resin and is blow molded or vacuum formed to the dimensions desired. The wipes may be, for example, fibrous materials, such as non-woven fabric, paper or gauze, formed in a sheet. The wipes may be impregnated with such liquids as liquid cosmetics, such as toilet water or lotion; drugs, such as an antiseptic or a medicine; cleaning solution for cleansing skin, including alcohol, moisturizing agent, surfactant, etc.; or solutions for cleansing surfaces such as kitchen counters or other surfaces, including alcohol, surfactants, etc. Of particular interest are wipes for cleansing of babies, or infants, at the time of diaper changing, which wipes may be impregnated with such materials as surfactants, alcohol, antimicrobials, moisturizing agents, and perfumes. The wipes may be made of a long continuous sheet-like tissue material, having perforation lines 23 transversely extending between its longitudinal sides at predetermined distances for separation of the sheet into short individual wipes, 21, as illustrated. As shown in FIG. 7, the wipes may be formed in a rope-like shape by gathering in a widthwise direction or in a tape-like shape by folding along a longitudinal direction, and rolled into a compact roll. It is also possible for the wipes to be rolled into a conventional roll, such as a toilet tissue roll configuration, from which the sheet-like material is drawn and separated into individual tissues by tearing at the perforations. Alternatively, the moist tissues or wipes of the present invention may be made of a plurality of short tissues which are partially overlapped at their edges with adjacent tissues, and which are formed into a long rope-like or tape-like shape, which may be continuously taken out of the dispenser for use because adjacent edges are overlapped and adhere to each other. In the preferred embodiment of the invention, the moist wipes are formed as a rope-like roll, 22, which is drawn upward from the interior of the wipes dispenser and through a hole or orifice, 15, in the lid, 10, of the closed dispenser. As the wipes are drawn through the hole in the lid, individual wipes, 21, may be torn off as desired, by tearing at a perforation 23 to obtain a wipe of the desired length.

Figure 5:
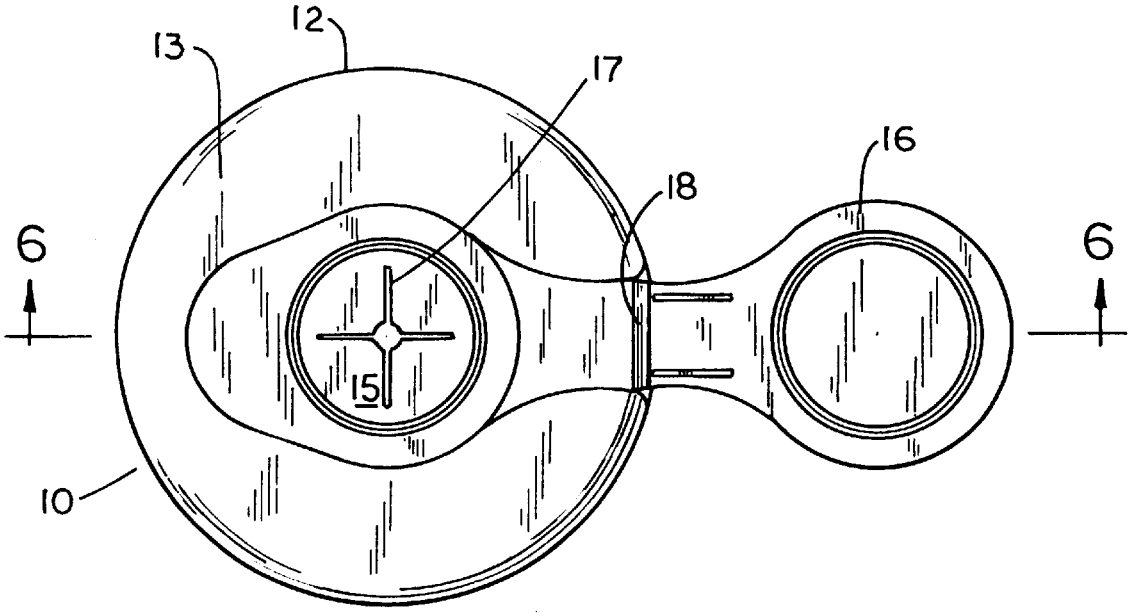
FIG. 5 is a top view of the lid of FIG. 4, illustrating the orifice and cap in open position.
Figure 6:
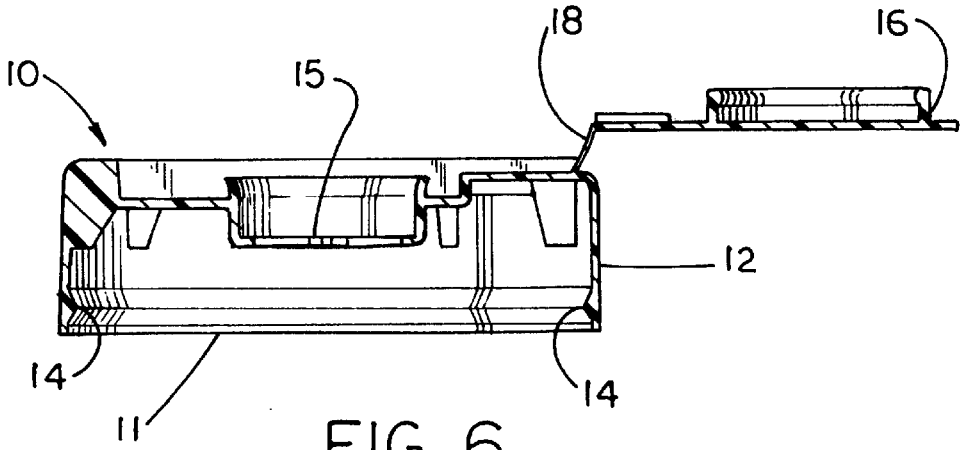
FIG. 6 is a section of the lid of FIG. 5, taken along line 6—6.

As illustrated by FIG. 1, the dispenser body 1, has vertical sides 2, and a top opening 7, through which the roll of wipes 22 is inserted into the dispenser. Since evaporation of the liquid contained within the wipes is to be avoided, so as to provide a wet wipe to the consumer, a lid, 10, as shown in FIGS. 4, 5, and 6, is provided to fit over the opening 7 in the dispenser body. As previously indicated, while this dispenser body may be of any cross-sectional configuration, it is illustrated herein in the form of a cylindrical dispenser for convenience, since this is the form most often employed. This lid has an opening, orifice, or hole therein, 15, through which the wet wipes are drawn, said orifice 15 being of reduced size relative to the opening 7 in the top of the body of the dispenser. The lid, as shown in FIG. 4, comprises a downwardly extending skirt, 12, which fits over the top edge of the dispenser, 1, extending a short distance down the vertical surface of the sides of the container. The lid, 10, is typically held in place by a snap-fit closure relationship with the dispenser, wherein an inwardly extending circumferential protrusion 14 is molded into the interior diameter of the downwardly extending skirt 12 of the lid, which protrusion cooperatively engages an outwardly extending circumferential closure flange 3, at or near the top edge of the body 1. In dispensers of the prior art, however, this has resulted in a lid, 10, fitting over a body, 1, with the lower edge thereof, 11, external to the vertical side of the cylindrical dispenser. This exposed lower edge, 11, has been subject to catching or interference when the closed dispensers are packaged, such as when they are inserted into packing boxes, especially when done by machine. Thus, the lids of conventional dispensers of wet wipes, or moist towelettes, have been subject to catching on the edge of the packing carton, for example, or on adjacent dispensers, as they are inserted into a packing carton, resulting in the lid being pulled upwardly, and off of the body of the dispenser. Such displacement has resulted in the evaporation of the liquid impregnated into the fibrous wipes, and thus the loss of the product. To counter this problem, it has been proposed to provide the container with smooth or rounded protrusions, 4, below the lower edge, 11, of the lid, 10, so as to provide a protective barrier to keep the lid from catching upon the edge of the packing carton, or on adjacent dispensers, during packing. Similar protrusions, 6, may be provided at the bottom of the dispenser, so as to space dispensers evenly within the packing container, and to aid in the insertion of dispensers during packing.

However, it has been found that such protective protrusions, 4, make it more difficult for the consumer to remove the lid, 10, from the dispenser, when necessary or desired. The lid, 10, of the dispenser comprises a planar top surface 13, which forms the top surface of the closed dispenser, as shown in FIG. 7. As previously mentioned, the lid is provided with an orifice, 15, through which the wipes are drawn, the orifice being of small diameter so as to limit evaporation of liquid from the enclosed roll of wet tissue. To further reduce loss of moisture from the wipes within the dispenser, the lid is further provided with a cap, 16, affixed to the lid 10 by hinge 18, which folds over the top of the dispensing hole 15, so as to provide a closure therefor. While the orifice, 15, is shown in FIGS. 4 and 7 as a small diameter hole, it may be of any appropriate shape, as is known in the prior art, such as intersecting slits, 17, as shown in FIG. 5.

As manufactured, packaged, and shipped, wipes dispensers conventionally are provided to the consumer with the cap 16 closed, normally with a removable tape or adherent plastic strip joining the outer surface of the cap with the top surface, 13, of the lid, 10, to assure that the cap has not been opened or disturbed between packing of the roll of wipes into the dispenser, and receipt by the consumer, and to ensure that no evaporation occurs through the hole 15. Further, a plastic or foil closure is often applied over the top opening 7 of the container, adhered at the circumferential edge thereof, so as to prohibit evaporation of liquid from the dispenser, as well as serving to assure the consumer that the package has not been opened prior to receipt by the consumer. Upon opening of the dispenser, by removal of the lid 10, and removal of any protective foil, film, and tape, and opening of the cap, 16, it is necessary for the consumer to thread the towels, tissues, or wipes through the hole, 15, in lid 10, for dispensing. After thus "starting" the wipes through the hole in the lid, the lid is then replaced upon the dispenser, and snapped in place by means of engaging closure flange 3 and lid protrusion 14.

As previously indicated, the lid 10 is locked in position on the dispenser body by means of engaging closure flange 3, on the dispenser body, and protrusion 14, on the inner circumference of the lid. Removal of the lid requires the consumer to press upwardly upon the lower edge, 11, of the lid, so as to displace the engaging protrusion 14 of the lid from the circumferential closure flange, 3, of the dispenser body. This removal is more difficult when the bottom edge, 11, of the lid is adjacent to a protective protrusion, or skirt protection means, 4, on the side wall 2, of the dispensing body, 1. Accordingly, an opening or slot, 5, is provided in the skirt protection protrusion 4, for insertion of the consumer's finger, thumb, or a tool or implement, for the purpose of removing the lid from the dispenser.

This slot, or opening, 5, permits the consumer to place a thumb, for example, in position under lower edge 11, and to push upwardly, thus removing lid 10, from the body 1 of the dispenser. The wipe, 21, may then be threaded through hole 15, in lid 10, and the lid replaced on the dispenser 10, snapping in position by engaging protrusions 14 of the lid and closure flange 3 of the body of the dispenser. Individual wipes may then be withdrawn from the dispenser as needed, tearing from the roll of wipes, 22, at perforations 23. After each individual wipe 21 is removed, cap 16 may then be closed over the opening 15, so as to protect the contents of the dispenser, and to prohibit loss of impregnating liquid therefrom by evaporation.

Of course, variations and modifications of the invention as set forth above are possible, and the above should be considered only as illustrative of a preferred embodiment of the invention. For example, it is possible for the vertical side of the cylindrical dispenser to be of a smaller diameter at the top, with the lid fitting over this smaller diameter, with the diameter of the cylindrical dispenser below the lid being larger, so as to be greater than the outside diameter of said lid. In such a case, a slot or opening may be formed in a portion of the outer skin of said vertical side, so as to permit ready access to the lower edge of said lid, without departing from the spirit and intent of the invention. Similarly, it is possible for the lid to have a peripheral depending skirt terminating in a thickened rim to fit into a corresponding circumferential recess in the cylindrical body of said dispenser.

INDUSTRIAL APPLICABILITY

The improvement as set forth herein for dispensers of moist wipes or other fibrous pads may be employed for any conventional container for such wipes wherein it is necessary or desirable to remove the lid of said dispenser. The dispensers comprise plastic containers of conventional manufacture, while the invention comprises an improvement therein by which removal of the lid is made easier, by virtue of the relationship between the lid, the body of the container, and protrusions encircling the container which protect the bottom edge of the lid. Having an opening slot in said protrusions for insertion of the consumer's finger, or other opening means, eases removal of the lid.

While the present invention has been described with respect to what is at present considered to be the preferred embodiments, it is to be understood that the invention is not to be limited to the disclosed embodiments. To the contrary, the invention is intended to cover various modifications and equivalent arrangements within the spirit and scope of the appended claims. The scope of the following claims is to be accorded the broadest interpretation so as to encompass all such modifications and equivalent formulations and functions.

We claim:

1. A dispenser containing wipes comprising a body containing a supply of wipes which may be withdrawn from said body sequentially, a lid removably attached over an open end of said body, said lid being held in position on said body by snap fit cooperative engagement of an inwardly extending circumferential protrusion on an interior surface of a downwardly extending skirt of said lid and an outwardly extending circumferential protrusion on an exterior surface of a vertical side wall of said body, said lid having an opening therein for withdrawal of said wipes, and said vertical side wall of said body having a second outwardly extending protrusion below and adjacent to a lower edge of said downwardly extending skirt of said lid, said second outwardly extending protrusion having an opening therein for access to said lower edge of said downwardly extending skirt of said lid, wherein said inwardly extending circumferential protrusion on the interior surface of the downwardly extending skirt of said lid engages a first region of the exterior surface of the vertical side wall of the body that is not recessed in relation to a second main region of the exterior surface of the vertical side wall of the body below the second outwardly extending protrusion.

2. The dispenser containing wipes of claim 1, wherein said wipes are impregnated with a liquid, and may be sequentially withdrawn from said dispenser by pulling through said opening in said lid.

3. The dispenser containing wipes of claim 2, wherein said wipes are sequentially separable from each other by tearing at a perforation between said wipes.

4. The dispenser containing wipes of claim 3, wherein said wipes are retained within said body in the form of a roll.

5. The dispenser containing wipes of claim 2, wherein said lid further comprises a cap removably attached thereto, said cap providing a closure for said opening in said lid.

6. The dispenser containing wipes of claim 5, wherein said wipes comprise cleansing wipes.

7. A dispenser containing liquid impregnated fibrous tissues, comprising:

a dispenser body comprising a synthetic resin container for said tissues, said body having a top opening therein;

a lid removably attachable to said dispenser body, said lid comprising a downwardly extending skirt which fits over said top opening, said lid having an opening therein for passage of said tissues;

a protective circumferential protrusion extending outwardly from a vertical side wall of said dispenser body below and adjacent to a lower edge of said downwardly extending skirt; and an opening in said protrusion permitting access to said lower edge of said downwardly extending skirt, wherein said lid is removably attachable to said dispenser body by means of a snap fit between said lid and said dispenser body, said snap fit being the result of cooperative engagement of an internally extending circumferential protrusion on an interior surface of the skirt of said lid and an externally extending circumferential protrusion on the vertical side wall of said dispenser body, wherein said inwardly extending circumferential protrusion on the interior surface of the skirt of said lid engages a first region of the exterior surface of the vertical side wall of the body that is not recessed in relation to a second main region of the exterior surface of the vertical side wall of the body below the protective circumferential protrusion.

8. The dispenser containing liquid impregnated fibrous tissues of claim 7, said lid further comprises a cap over said opening for passage of said tissues.

9. The dispenser containing liquid impregnated fibrous tissues of claim 8, wherein said cap is removably attached to said lid.

10. The dispenser containing liquid impregnated fibrous tissues of claim 9, wherein said dispenser body is cylindrical.

* * * * *